US006230534B1

(12) United States Patent
Sato et al.

(10) Patent No.: US 6,230,534 B1
(45) Date of Patent: May 15, 2001

(54) PROCESS FOR MANUFACTURING A COLD ROLLED STAINLESS STEEL STRIP HAVING A HIGH GLOSS

(75) Inventors: Shigeru Sato; Yasuhiro Yamaguchi; Tsutomu Matsubara, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/423,460

(22) PCT Filed: Mar. 23, 1999

(86) PCT No.: PCT/JP99/01445

§ 371 Date: Nov. 9, 1999

§ 102(e) Date: Nov. 9, 1999

(87) PCT Pub. No.: WO99/48628

PCT Pub. Date: Sep. 30, 1999

(30) Foreign Application Priority Data

Mar. 24, 1998 (JP) ..... 10-076109
Jul. 30, 1998 (JP) ..... 10-215314

(51) Int. Cl.[7] ..... B21B 39/20
(52) U.S. Cl. ..... 72/252.5; 72/199

(58) Field of Search ..... 72/199, 252.5, 72/198, 197, 196, 365.2, 366.2, 379.2

(56) References Cited

U.S. PATENT DOCUMENTS 4,250,726 * 2/1981 Safian et al. ..... 72/38
4,996,113 * 2/1991 Hector et al. ..... 72/199
5,537,851 * 7/1996 Sheu et al. ..... 72/366.2

FOREIGN PATENT DOCUMENTS 1-197004 8/1989 (JP) .
7-155809 6/1995 (JP) .

* cited by examiner

*Primary Examiner*—Rodney A. Butler
(74) *Attorney, Agent, or Firm*—Oliff & Berridge, PLC

(57) ABSTRACT

A process for manufacturing a cold rolled stainless steel strip of high gloss with a high production efficiency by employing a high rolling speed. Mirror-finished work rolls having a Young's modulus exceeding 54,000 kgf/mm$^2$ and a center-line average surface roughness, Ra, not exceeding 0.10 micron are employed for the last of a plurality of successive passes for cold rolling, while the steel to be drawn between the rolls for the last pass has a centerline average surface roughness, Ra, of 0.05 to 0.30 micron.

9 Claims, 1 Drawing Sheet

Figure 1:
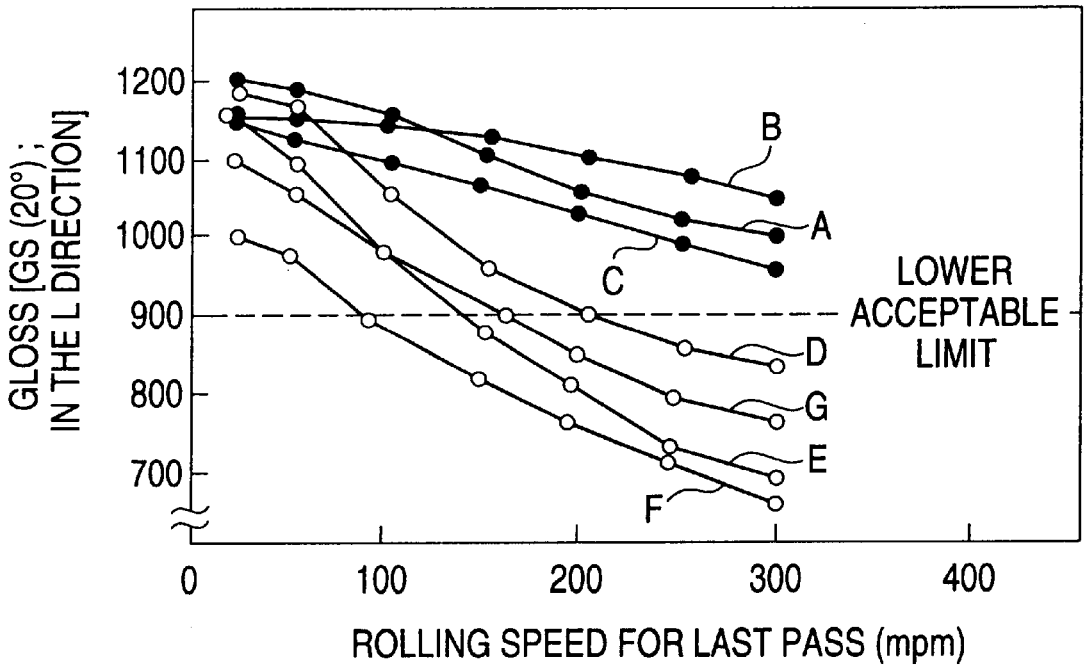

PROCESS FOR MANUFACTURING A COLD ROLLED STAINLESS STEEL STRIP HAVING A HIGH GLOSS

FIELD OF THE INVENTION

This invention relates to a process for manufacturing a cold rolled stainless steel strip having a high surface brightness, or gloss.

BACKGROUND OF THE INVENTION

In order to produce a stainless steel strip of improved gloss, it has been common practice to use a rolling mill lubricant(oil) of low viscosity, or work rolls having a small diameter to decrease the amount of the oil caught in the bite between the rolls and thereby enhance the transfer of the controlled roughness of the roll surfaces to the strip surfaces.

JP-A-7-155809 discloses a process employing rolls having a controlled surface roughness to produce a high gloss. It employs smooth rolls having a centerline average surface roughness, Ra, of 0.01 to 0.06 micron for at least the last two passes, and may further include temper rolling which is effected by employing similar smooth rolls without lubrication to achieve a reduction in thickness of 0.3 to 3.0%.

There is also known a process which employs mirror-finished work rolls having a Young's modulus of 31,000 to 54,000 kgf/mm$^2$ for the last pass in the manufacture of a metal foil having a high degree of surface brightness, as described in JP-A-1-197004.

The known processes have, however, been unable to achieve the desired gloss in any operation employing a high rolling speed, particularly for the last pass, and have, therefore, been able to achieve only a low efficiency in the production of stainless steel strips.

Under these circumstances, it is an object of this invention to provide a process which can manufacture a cold rolled stainless steel strip of high gloss with a high efficiency.

SUMMARY OF THE INVENTION

This invention is a process for manufacturing a cold rolled stainless steel strip of high gloss in which mirror-finished work rolls having a Young's modulus exceeding 54,000 kgf/mm$^2$ and a centerline average surface roughness, Ra, not exceeding 0.10 micron are employed for the last of a plurality of successive passes for cold rolling, while the steel to be drawn between the rolls for the last pass has a centerline average surface roughness, Ra, of 0.05 to 0.30 micron.

BRIEF DESCRIPTION DRAWING

FIG. 1 is a graph showing the gloss of the products of Examples of this invention and Comparative Examples in relation to the rolling speed employed for the last pass.

DETAILED DESCRIPTION OF EXEMPLARY EMBODIMENTS OF

According to this invention, mirror-finished work rolls having a Young's modulus exceeding 54,000 kgf/mm$^2$ and a centerline average surface roughness, Ra, not exceeding 0.10 micron are employed for the last of a plurality of successive passes for cold rolling, while the steel to be drawn between the rolls for the last pass has a centerline average surface roughness, Ra, of 0.05 to 0.30 micron. As a result, steel does not have its gloss lowered, even if it may be rolled at such a high speed as has allowed only a product of low gloss to be obtained by any known process. Thus, this invention enables a stainless steel strip of high gloss to be manufactured at a high rolling speed.

The work rolls used for the last pass have a Young's modulus exceeding 54,000 kgf/mm$^2$. If they have a Young's modulus lower than 54,000 kgf/mm$^2$, it is likely that the rolls may be excessively flattened by a heavy load acting thereon, depending on a reduction of thickness to be effected by the last pass, and may consequently hold a large amount of oil therebetween, and allow wrinkle-like defects called oil pits to occur to a strip along its width. Only an extremely limited range of reduction in thickness is allowable for obtaining a high gloss, and the necessary reduction calls for a larger number of passes resulting in a lower production efficiency.

The work rolls have a centerline average surface roughness, Ra, not exceeding 0. 10 micron. If they have an Ra value exceeding 0. 10 micron, a pattern formed by lapping remains until after a skin pass, and makes a product of low quality which is not commercially acceptable.

The steel to be drawn between the work rolls for the last pass has an Ra value of 0.05 to 0.30 micron. If its Ra value is less than 0.05 micron, a larger amount of oil is caught between the rolls at a higher rolling speed, and makes oil pits more likely to occur. If its Ra value is over 0.30 micron, oil flows through the concavities in the steel surfaces and around the rolls from the inlet of their bite to its outlet, and as the bite holds a smaller amount of oil, the rolls fail to rectify the roughness of the steel surfaces satisfactorily, though oil pits may be restrained from occurring. In either event, a product of high gloss is difficult to obtain.

If the work rolls have a centerline average surface roughness, Ra, exceeding 0.03 micron, and not exceeding 0.10 micron, a still better gloss can be obtained if the steel to be drawn between the rolls for the last pass has a centerline average surface roughness, Ra, of 0.05 to 0.10 micron. If the rolls have an Ra exceeding 0.03 micron, and if the steel to be finished has a lower surface roughness in the range of 0.05 to 0.10 micron, it is apparently possible to decrease the amount of the rolling mill lubricant caught between the rolls, and thereby restrain still more effectively the occurrence of oil pits which would be formed by an oil film having a larger thickness.

If the work rolls have a lower centerline average surface roughness, Ra, not exceeding 0.03 micron, a still better gloss can also be obtained if the steel to be drawn between the rolls for the last pass has a centerline average surface roughness, Ra, of 0.10 to 0.30 micron. If the rolls have a lower Ra not exceeding 0.03 micron, and if the steel to be finished has a surface roughness of 0.10 to 0.30 micron, it is obviously possible to restrain the formation of oil pits still more effectively, as the rolling mill lubricant is allowed to flow out along the ground steel surfaces. Examples:

SUS 304 stainless steel strips were manufactured by continuous cold rolling under the conditions as shown in Table 1. For Examples of this invention, WC (tungsten carbide) rolls having a Young's modulus of 57,000 kgf/mm$^2$ and a centerline average surface roughness, Ra, of 0.018 to 0.09 micron were employed as the work rolls for the last pass, while the steel to be drawn between the rolls for the last pass had a surface roughness, Ra, of 0.10 or 0.20 micron, and stainless steel strips having a thickness of 0.95 mm were manufactured by employing different rolling speeds for the last pass, and were examined for their gloss [Gs (20°); in the L direction] in accordance with Japanese Industrial Standard (JIS) Z 8741.

For Comparative Examples, strips were manufactured by employing WC rolls having a Young's modulus of 57,000 kgf/mm$^2$ and a centerline average surface roughness, Ra, of 0.018 or 0.20 micron, or high-speed steel rolls having a Young's modulus of 21,000 kgf/mm$^2$ and a centerline average surface roughness, Ra, of 0.018 micron, while the steel to be drawn between the rolls for the last pass had a surface roughness, Ra, of 0.040 or 0.10 micron, and they were likewise examined for their gloss.

FIG. 1 is a graph showing the gloss of the products of Examples (A, B and C) of this invention and Comparative Examples (D, E, F and G) in relation to the rolling speed employed for the last pass. As is obvious from FIG. 1, those products of Comparative Example D which had been manufactured by employing a rolling speed higher than 200 mpm for the last pass had a gloss lower than the lower acceptable limit, and it was, therefore, essential to employ a lower rolling speed and spend a longer rolling time. On the other hand, even those products of Examples A ,B and C which had been manufactured by employing a rolling speed of 300 mpm for the last pass had a gloss higher than the lower acceptable limit, and it is, thus, obvious that this invention ensures a greatly improved production efficiency.

While a few combinations of conditions selected from within the essential features of this invention have been shown as the Examples thereof, it is to be understood that they are not intended for limiting the scope of this invention, but that results similar to those described above can be obtained by employing any other combination falling within the scope of this invention as defined by the claims.

TABLE 1

| Test No. | Young's modulus of work rolls | Surface roughness of work rolls used for last pass | Surface roughness of steel to be drawn between rolls for last pass | Symbol of Example | Remarks |
|---|---|---|---|---|---|
| 1 | 57,000 kgf/mm$^2$ | Ra:0.018 $\mu$m | Ra:0.10 $\mu$m | A | Example No. 1 of the Invention |
| 2 | 57,000 kgf/mm$^2$ | Ra:0.08 $\mu$m | Ra:0.10 $\mu$m | B | Example No. 2 of the Invention |
| 3 | 57,000 kgf/mm$^2$ | Ra:0.09 $\mu$m | Ra:0.20 $\mu$m | C | Example No. 3 of the Invention |
| 4 | 57,000 kgf/mm$^2$ | Ra:0.018 $\mu$m | Ra:0.04 $\mu$m | D | Comparative Example No. 1 |
| 5 | 21,000 kgf/mm$^2$ | Ra:0.018 $\mu$m | Ra:0.10 $\mu$m | E | Comparative Example No. 2 |
| 6 | 57,000 kgf/mm$^2$ | Ra:0.018 $\mu$m | Ra:0.40 $\mu$m | F | Comparative Example No. 3 |
| 7 | 57,000 kgf/mm$^2$ | Ra:0.20 $\mu$m | Ra:0.10 $\mu$m | G | Comparative Example No. 4 |

Thus, it is an excellent advantage of this invention that it enables a cold rolled stainless steel strip having a high gloss to be manufactured with a higher production efficiency by employing a higher rolling speed than has hitherto been possible.

What is claimed is:

1. A method for manufacturing a cold rolled stainless steel strip, comprising:

cold rolling the strip by successively passing the strip between a plurality of pairs of opposed work rolls, wherein each work roll of a last pair of opposed work rolls of the plurality of pairs of opposed work rolls has a Young's modulus of at least 54,000 kgf/mm$^2$ and a centerline average surface roughness not exceeding 0.10 $\mu$m and a centerline average surface roughness of the strip passing between the last pair of opposed work rolls is about 0.05 $\mu$m to 0.30 $\mu$m.

2. The method of claim 1, wherein each work roll of the last pair of opposed work rolls is mirror-finished.

3. The method of claim 1, wherein each work roll of the last pair of opposed work rolls is formed of tungsten carbide.

4. A method for manufacturing a cold rolled stainless steel strip, comprising:

cold rolling the strip by successively passing the strip between a plurality of pairs of opposed work rolls, wherein each work roll of a last pair of opposed work rolls of the plurality of pairs of opposed work rolls has a Young's modulus of at least 54,000 kgf/mm$^2$ and a centerline average surface roughness is about 0.03 $\mu$m to 0.10 $\mu$m and a centerline average surface roughness of the strip passing between the last pair of opposed work rolls is about 0.05 $\mu$m to 0.10 $\mu$m.

5. The method of claim 4, wherein each work roll of the last pair of opposed work rolls is mirror-finished.

6. The method of claim 4, wherein each work roll of the last pair of opposed work rolls is formed of tungsten carbide.

7. A method for manufacturing a cold rolled stainless steel strip, comprising:

cold rolling the strip by successively passing the strip between a plurality of pairs of opposed work rolls, wherein each work roll of a last pair of opposed work rolls of the plurality of pairs of opposed work rolls has a Young's modulus of at least 54,000 kgf/mm$^2$ and a centerline average surface roughness not exceeding 0.03 $\mu$m and a centerline average surface roughness of the strip passing between the last pair of opposed work rolls is about 0.10 $\mu$m to 0.30 $\mu$m.

8. The method of claim 7, wherein each work roll of the last pair of opposed work rolls is mirror-finished.

9. The method of claim 7, wherein each work roll of the last pair of opposed work rolls is formed of tungsten carbide.

* * * * *